US010008817B2

(12) United States Patent
Fullerton et al.

(10) Patent No.: US 10,008,817 B2
(45) Date of Patent: *Jun. 26, 2018

(54) ELECTRICAL ADAPTER SYSTEM

(71) Applicant: Correlated Magnetics Research, LLC, Huntsville, AL (US)

(72) Inventors: Larry W. Fullerton, New Hope, AL (US); Mark D. Roberts, Huntsville, AL (US)

(73) Assignee: Correlated Magnetics Research, LLC, Huntsville, AL (US)

( * ) Notice: Subject to any disclaimer, the term of this patent is extended or adjusted under 35 U.S.C. 154(b) by 16 days.

This patent is subject to a terminal disclaimer.

(21) Appl. No.: 15/095,970

(22) Filed: Apr. 11, 2016

(65) Prior Publication Data

US 2016/0226207 A1 Aug. 4, 2016

Related U.S. Application Data

(63) Continuation-in-part of application No. 14/258,787, filed on Apr. 22, 2014, now Pat. No. 9,312,634, (Continued)

(51) Int. Cl.
*H01R 31/06* (2006.01)
*H01R 33/22* (2006.01)
(Continued)

(52) U.S. Cl.
CPC ..... *H01R 31/065* (2013.01); *H01R 13/6205* (2013.01); *H01R 13/6675* (2013.01); *H01R 33/22* (2013.01)

(58) Field of Classification Search
CPC ... H01R 31/065; H01R 33/22; H01R 13/6205
(Continued)

(56) References Cited

U.S. PATENT DOCUMENTS 3,521,216 A * 7/1970 Tolegian ..... H01R 13/6205 439/152
3,808,577 A * 4/1974 Mathauser ..... H01R 13/6205 439/180

(Continued)

*Primary Examiner* — Alexander Gilman
(74) *Attorney, Agent, or Firm* — Robert S. Babayi

(57) ABSTRACT

An electrical system includes an electrical adapter and a stackable electrical adapter. The electrical adapter includes at least one of an electrical plug or an Edison screw base configured to receive a primary voltage, a voltage converter circuit configured to convert the primary voltage to the secondary voltage, and a first electrical connector part configured to be detachably coupled to a second electrical connector part of an electrical fixture configured to be powered by the secondary voltage. The stackable electrical adapter is configured to be powered by the secondary voltage, the first stackable electrical adapter having a first side and a second side opposite the first side. The electrical adapter is configured to be electrically connected to the first side of the first stackable electrical adapter or to an electrical fixture using a two part electrical connector to provide the secondary voltage and a ground, the electrical fixture is configured to be powered by the secondary voltage, where the second side of the stackable electrical adapter is configured to be electrically connected to the electrical fixture or to be daisy-chained to a second stackable electrical adapter using the two part electrical connector to provide the secondary voltage and a ground, the second stackable electrical adapter being configured to be electrically connected to the electrical adapter and the electrical fixture and to be daisy-chained to the first stackable electrical adapter using the two part electrical connector to provide the secondary voltage and a ground.

18 Claims, 14 Drawing Sheets

Related U.S. Application Data which is a continuation of application No. 13/430,219, filed on Mar. 26, 2012, now Pat. No. 8,702,437.

(60) Provisional application No. 62/297,001, filed on Feb. 18, 2016, provisional application No. 61/465,801, filed on Mar. 24, 2011.

(51) Int. Cl.
*H01R 13/62* (2006.01)
*H01R 13/66* (2006.01)

(58) Field of Classification Search
USPC ..... 439/620.02
See application file for complete search history.

(56) References Cited

U.S. PATENT DOCUMENTS 4,222,489 A * 9/1980 Hutter ..... A47F 7/0042 211/45
4,416,127 A * 11/1983 Gomez-Olea Naveda ..... G07C 9/0073 70/276
4,645,283 A * 2/1987 MacDonald ..... H01R 33/94 315/56
5,050,276 A * 9/1991 Pemberton ..... A44C 5/2076 24/303
5,582,522 A * 12/1996 Johnson ..... H01R 25/00 439/214
5,759,054 A * 6/1998 Spadafore ..... F21V 19/0095 439/236
6,120,283 A * 9/2000 Cousins ..... F21V 35/00 248/511
6,234,833 B1 * 5/2001 Tsai ..... H01R 13/506 439/188
6,433,493 B1 * 8/2002 Ilyes ..... H05B 39/045 315/200 R
6,720,698 B2 * 4/2004 Galbraith ..... H02K 39/00 123/149 R
6,913,471 B2 * 7/2005 Smith ..... H05K 1/144 439/541.5
7,066,739 B2 * 6/2006 McLeish ..... H01R 13/6205 439/39
7,137,727 B2 * 11/2006 Joseph ..... B82Y 15/00 362/419
7,148,440 B2 * 12/2006 Gjerde ..... H01H 19/06 200/568
7,264,479 B1 * 9/2007 Lee ..... H01R 11/30 439/39
7,276,025 B2 * 10/2007 Roberts ..... A61B 1/227 315/312
7,339,790 B2 * 3/2008 Baker ..... H01K 1/325 315/57
7,467,948 B2 * 12/2008 Lindberg ..... H01R 13/6205 439/38
7,812,697 B2 * 10/2010 Fullerton ..... H01F 7/0284 335/285
7,832,897 B2 * 11/2010 Ku ..... F21S 2/005 362/249.02
7,874,856 B1 * 1/2011 Schriefer ..... H01R 13/514 439/214
7,903,397 B2 * 3/2011 McCoy ..... H01R 31/06 361/679.01
7,905,626 B2 * 3/2011 Shantha ..... H01J 5/54 362/228
8,002,585 B2 * 8/2011 Zhou ..... F21V 19/04 439/320
8,497,753 B2 * 7/2013 DiFonzo ..... H01R 13/6205 335/205
8,734,165 B2 * 5/2014 Neel ..... H01R 11/30 439/39
8,836,224 B2 * 9/2014 Chen ..... H02M 7/003 315/185 R
2004/0003487 A1 * 1/2004 Reiter ..... A41F 1/002 24/303
2006/0105586 A1 * 5/2006 Zhang ..... H02M 3/073 439/1
2007/0072476 A1 * 3/2007 Milan ..... H01R 25/003 439/373
2010/0167576 A1 * 7/2010 Zhou ..... H01R 33/942 439/375
2012/0021619 A1 * 1/2012 Bilbrey ..... H01R 13/6205 439/39
2012/0028480 A1 * 2/2012 Bilbrey ..... H01R 13/6205 439/39
2012/0146513 A1 * 6/2012 Radermacher ..... F21V 25/04 315/119
2012/0244732 A1 * 9/2012 Fullerton ..... H01R 13/6205 439/236
2014/0350701 A1 * 11/2014 Underwood ..... H01R 9/2408 700/83

* cited by examiner

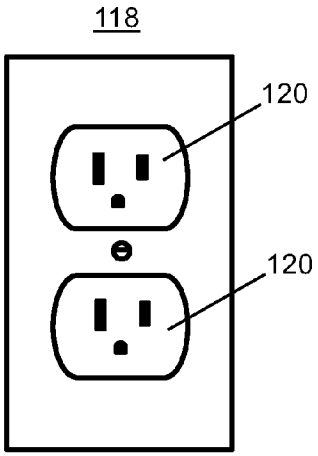
FIG. 1C
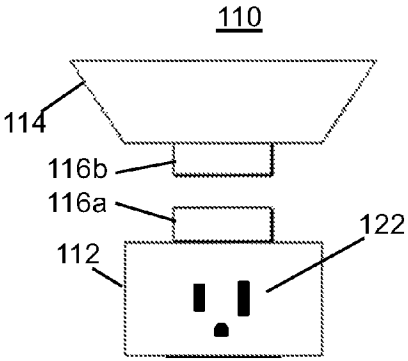
FIG. 1D (Front View)
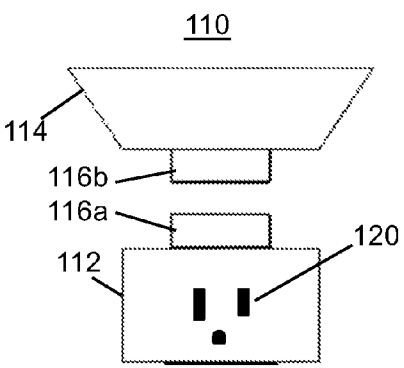
FIG. 1E (Back View)
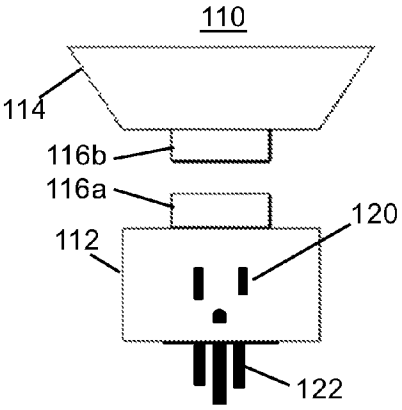
FIG. 1F (Front View)
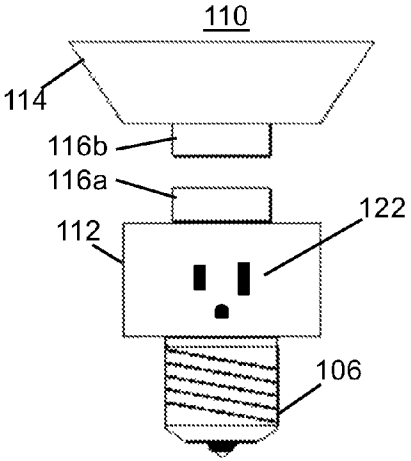
FIG. 1G (Front View)
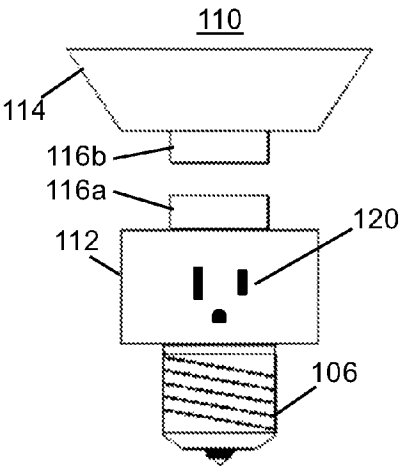
FIG. 1H (Back View)

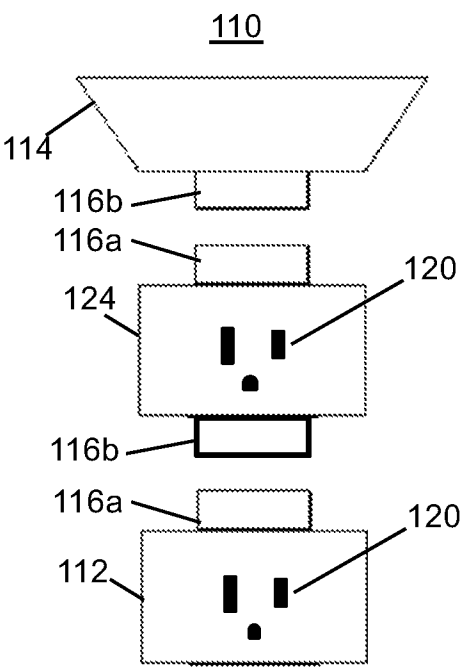
FIG. 1J (Back View)
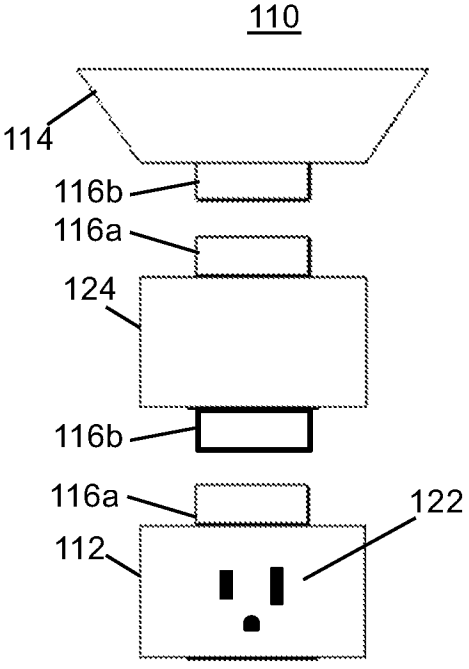
FIG. 1I (Front View)

ELECTRICAL ADAPTER SYSTEM

CROSS-REFERENCE TO RELATED APPLICATIONS

This patent application is a continuation-in-part of U.S. Non-provisional application Ser. No. 14/258,787, filed Apr. 22, 2014, titled "Electrical Adapter System", which is a continuation of U.S. Pat. No. 8,702,437, issued Apr. 22, 2014, titled "Electrical Adapter System", which claims the priority benefit of U.S. Provisional Application No. 61/465,801, filed Mar. 24, 2011, titled "Electrical Adapter System".

This patent application claims the priority benefit of U.S. Provisional Application No. 62/297,001, filed Feb. 18, 2016, titled "Stackable Electrical Adapters".

These applications are incorporated herein by reference in their entirety.

FIELD OF THE INVENTION

The present invention relates generally to an electrical adapter system. More particularly, the present invention relates to an electrical adapter system including an electrical adapter for connecting to an electrical fixture.

BACKGROUND OF THE INVENTION

In 1962, Hanna-Barbera Production, Inc. produced a cartoon titled "The Jetsons" that featured the Jetson family living in a utopian future having incredible conveniences based on communication devices, large and small displays, and even robots. Everything they wanted required only a voice command or a push of a button.

In 1966, a television show titled "Star Trek" debuted that followed the interstellar adventures of James T. Kirk and the crew of the Enterprise. Star Trek is known for its influence on the world outside of science fiction for inspiring inventions such as desktop and tablet computers, wireless head phones, biometrics, cell phones, and even the automated sliding door.

An epic science fiction film released in 1968 titled "2001: A Space Odyssey" follows a voyage of a U.S. spacecraft to Jupiter. The film had tablet computers like Star Trek but also had two-way video conferencing, a suitcase phone, a voice controlled chessboard, and a sentient computer named HAL having artificial intelligence.

Forty-three years later, Apple® introduced the iPhone 4S®, which includes a computer program called Siri® that works as an intelligent personal assistant and knowledge navigator. Siri uses a natural language user interface to answer questions, make recommendations, and perform actions. Siri adapts to a user's individual language usage and preferences and returns individualized results.

Many vehicles now offer various features activated by voice commands such as making telephone calls, selecting music, and interfacing with car navigation systems to find nearby restaurants, hotels or gas stations or to receive driving directions to a known address. Pioneer sells a car receiver that connects to an iPhone to take advantage of Siri® Eyes Free functionality including listening to text messages, calendar information, and reminders.

A home automation system integrates electrical devices in a house with each other. The techniques employed in home automation include those in building automation as well as the control of domestic activities, such as home entertainment systems, houseplant and yard watering, pet feeding, changing the ambiance "scenes" for different events (such as dinners or parties), lighting control system, and the use of domestic robots. Devices may be connected through a home network to allow control by a personal computer, and may allow remote access from the internet. Through the integration of information technologies (e.g., PCs, phones) with the home environment, systems and appliances can communicate in an integrated manner which results in convenience, energy efficiency, and safety benefits.

Automated "homes of the future" have been staple exhibits for World's Fairs and popular backgrounds in science fiction. However, problems with complexity, competition between vendors, multiple incompatible standards, and the resulting expense have limited the penetration of home automation to homes of the wealthy or ambitious hobbyists.

Current voice-controlled home automation systems typically involve wall-mounted control panels that provide a combination of touch and voice-controlled features. Such systems typically require a person to be standing next to the control panel, which substantially limits the 'value add' of using voice commands over using touch features of the control panel or a phone.

Technology improvements are needed to remove current limitations and inefficiencies of home (and business) automation systems.

SUMMARY OF THE INVENTION

In accordance with a first aspect of the invention, a stackable electrical adapter comprises one of a first electrical connector part that is located on a first side of the stackable electrical adapter, the first electrical connector part being configured to be detachably coupled to an electrical adapter, the electrical adapter comprising at least one of an electrical plug or an Edison screw base configured to receive a primary voltage from a primary voltage source; and a voltage converter circuit configured to convert the primary voltage to a secondary voltage; and one of a second electrical connector part that is located on a second side of the stackable electrical adapter that is opposite the first side, the second electrical connector part being configured to be detachably coupled to an electrical fixture configured to be powered by the secondary voltage, each of the first electrical connector part and the second electrical connector part comprising a first contact portion for providing a secondary voltage; and a second contact portion for providing a ground, the first and second contact portions of each the first electrical connector part being configured to provide an electrical connection with the first and second contact portions of each the second electrical connector part enabling daisy-chaining of multiple stackable electrical adapters.

Each of the first electrical connector part and the second electrical connector part may comprise a third contact portion for providing a data signal.

The primary voltage source can be an electrical socket of an electrical outlet.

The stackable electrical adapter may comprise an audio input device, an audio output device, a video input device, a video output device, a radar, an environment sensor, a network communications device, a security sensor, a timer device, a remote control repeater device, or a rechargeable battery.

At least one of the stackable electrical adapter or the electrical fixture can function as part of one of a communication system, a tracking system, a security system, an environment control system, an environment monitoring system, a gaming system, an automation system, or a media delivery system.

At least one of the stackable electrical adapter or the electrical fixture may comprise at least one of a transponder, a transmitter, a receiver, or an antenna.

The electrical adapter can convey signals via a wiring infrastructure to which an electrical outlet or an electrical fixture having an Edison screw light bulb socket is interfaced.

In accordance with a first aspect of the invention, an electrical adapter system comprise an electrical adapter, comprising at least one of an electrical plug or an Edison screw base configured to receive a primary voltage from a primary voltage source; a voltage converter circuit configured to convert the primary voltage to a secondary voltage; and one of a first electrical connector part configured to be detachably coupled to one of a second electrical connector part of an electrical fixture configured to be powered by the secondary voltage; and at least one stackable electrical adapter configured to be placed between the electrical adapter and the electrical fixture, each the stackable electrical adapter of the at least one stackable electrical adapter having one of the first electrical connector part that is located on a first side and having one of the second electrical connector part that is located on a second side that is opposite the first side, each the first electrical connector part and each the second electrical connector part comprising a first contact portion for providing the secondary voltage; and a second contact portion for providing a ground, the first and second contact portions of each the first electrical connector part being configured to provide an electrical connection with the first and second contact portions of each the second electrical connector part enabling daisy-chaining of multiple stackable electrical adapters between the electrical adapter and the electrical fixture.

Each of the first electrical connector part and the second electrical connector part may comprise a third contact portion for providing a data signal.

The electrical adapter may further comprise another electrical socket that outputs a voltage based on the primary voltage.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

FIG. 1C depicts an exemplary electrical outlet;

FIG. 1D depicts a front view of an exemplary multi-part electrical system in accordance with the present invention;

FIG. 1E depicts a back view of the exemplary electrical adapter system of FIG. 1D;

FIG. 1F depicts a front view of another exemplary electrical adapter system in accordance with the present invention;

FIG. 1G depicts a front view of yet another exemplary electrical adapter system in accordance with the present invention;

FIG. 1H depicts a back view of the exemplary electrical adapter system of FIG. 1G;

FIG. 1I depicts a front view of still another exemplary electrical adapter system in accordance with the present invention that includes a stackable adapter;

FIG. 1J depicts a back view of the exemplary electrical adapter system of FIG. 1I;

DETAILED DESCRIPTION OF THE INVENTION

Figure 1B:
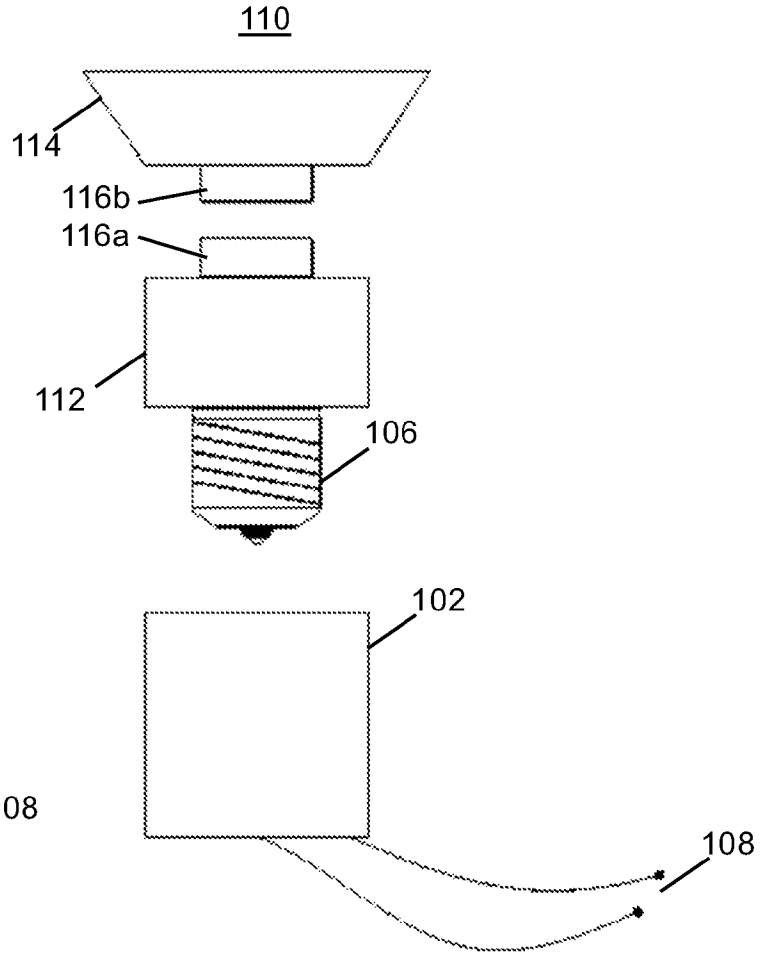
FIG. 1B depicts an exemplary electrical adapter system in accordance with the present invention comprising an electrical adapter and an exemplary electrical fixture.

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

The present invention provides an electrical adapter system. It involves magnetic techniques related to those described in U.S. Pat. No. 7,800,471, issued Sep. 21, 2010, U.S. Pat. No. 7,868,721, issued Jan. 11, 2011, U.S. Pat. No. 8,179,219, issued May 15, 2012, and U.S. Pat. No. 7,982,56, issued Jul. 19, 2011, which are all incorporated herein by reference in their entirety. The present invention may be applicable to systems and methods described in U.S. Pat. No. 7,681,256, issued Mar. 23, 2010, U.S. Pat. No. 7,750,781, issued Jul. 6, 2010, U.S. Pat. No. 7,755,462, issued Jul. 13, 2010, U.S. Pat. No. 7,812,698, issued Oct. 12, 2010, U.S. Pat. Nos. 7,817,002, 7,817,003, 7,817,004, 7,817,005, and 7,817,006, issued Oct. 19, 2010, U.S. Pat. No. 7,821,367, issued Oct. 26, 2010, U.S. Pat. Nos. 7,823,300 and 7,824,083, issued Nov. 2, 2010, U.S. Pat. No. 7,834,729, issued Nov. 16, 2010, U.S. Pat. No. 7,839,247, issued Nov. 23, 2010, U.S. Pat. Nos. 7,843,295, 7,843,296, and 7,843,297, issued Nov. 30, 2010, U.S. Pat. No. 7,893,803, issued Feb. 22, 2011, U.S. Pat. Nos. 7,956,711 and 7,956,712, issued Jun. 7, 2011, U.S. Pat. Nos. 7,951,068 and 7,958,575, issued Jun. 14, 2011, U.S. Pat. No. 7,963,818, issued Jun. 21, 2011, U.S. Pat. Nos. 8,015,752 and 8,016,330, issued Sep. 13, 2011, U.S. Pat. No. 8,035,260, issued Oct. 11, 2011, U.S. Pat. No. 8,115,581, issued Feb. 14, 2012, and U.S. patent application Ser. No. 12/895,589, filed Sep. 30, 2010, which are all incorporated by reference herein in their entirety. The invention may also incorporate techniques described in U.S. Provisional Patent Application 61/403,814, filed Sep. 22, 2010, U.S. Provisional Patent Application 61/455,820, filed Oct. 27, 2010, U.S. Provisional Patent Application 61/459,329, filed Dec. 10, 2010, U.S. Provisional Patent Application 61/459,994, filed Dec. 22, 2010, U.S. Provisional Patent Application 61/461,570, filed Jan. 21, 2011, and U.S.

Provisional Patent Application 61/462,715, filed Feb. 7, 2011, which are all incorporated by reference herein in their entirety.

In accordance with one embodiment of the invention, an electrical adapter system comprises an electrical adapter and an electrical fixture. The electrical adapter provides an electrical connection to an Edison screw socket. The electrical adapter includes an Edison screw base, a voltage converter circuit, and a first electrical connector part.

The Edison screw base is configured to receive a primary voltage from a voltage source. The adapter receives the primary voltage, for example 120 VAC, from an Edison screw light bulb socket and converts the primary voltage using the voltage converter circuit as required to supply a secondary, typically lower, and optionally variable voltage required by the electrical fixture.

Voltage converter circuit is configured to convert the primary voltage to the secondary voltage. The voltage converter circuit may be a switched mode power supply such as a buck converter.

The first electrical connector part is configured to be detachably coupled to a second electrical connector part of an electrical fixture configured to be powered by the secondary voltage. The first electrical connector part and second electrical connector part form a two part correlated magnetic electrical connector connecting the electrical adapter and electrical fixture.

Under one arrangement, the two parts of the correlated magnetic electrical connector to have a fixed position when magnetically aligned. For example, the two parts are fixed (i.e., unable to move) within the electrical adapter and electrical fixtures. In another arrangement, at least one of the two parts of the correlated magnetic electrical connector can move within a bounded area(s) within the electrical adapter and/or the electrical fixture. A moveable part of the correlated magnetic electrical connector may be located to a position and then held in that position by a lock, which may be some mechanical means such as a set screw. Generally, any of various well known mechanical means can to "lock" and "unlock" a connector in accordance with the invention.

In an exemplary embodiment, the electrical adapter comprises a driver circuit and the electrical fixture comprises a light emitting diode (LED) lamp, where the driver circuit can provide a variable secondary voltage enabling control over the LED lamp brightness and power consumption.

In another embodiment, an electrical fixture and/or an electrical adapter (or stackable adapter) may comprise one or more of an audio input device (e.g., a microphone), an audio output device (e.g., a speaker), a video input device (e.g., a movie camera), a video output device (e.g., a display), a radar (e.g., an ultra wideband radar), an environment sensor (e.g., a temperature, moisture, carbon dioxide, radon, smoke, or other sensor), a network communications device (e.g., a communications repeater device, a network router, or a communications portal), a security sensor (e.g., a motion sensor, infrared sensor, optical sensor, or other sensor), a light fixture (e.g., Christmas tree lights), a timer device, a remote control repeater device, or a rechargeable battery (e.g., to enable emergency lighting).

In a further embodiment, an electrical fixture and/or an electrical adapter (or stackable adapter) may function as part of a communication system, a person/object/animal tracking system, a security system, an environment control system, a environment monitoring system, a gaming system, an automation system, or a media (e.g., audio, video) delivery system. For example, an electrical adapter could include Blue Tooth or WiFi communications capabilities.

Under one arrangement, an electrical fixture and/or an electrical adapter (or stackable adapter) comprises at least one of a transponder, a transmitter, a receiver, or an antenna.

Under another arrangement, an electrical adapter conveys communications signals via a wiring infrastructure to which an electrical outlet or an electrical fixture having an Edison screw light bulb socket is interfaced or otherwise connected. Under still another arrangement, an electrical adapter conveys tracking signals (e.g., time-domain reflectometry signals) via such a wiring infrastructure.

The magnetic sources employed in the invention may be permanent magnetic sources, electromagnets, electro-permanent magnets, or combinations thereof. Magnetic sources may be discrete magnets or may be printed into magnetizable material.

Figure 1A:
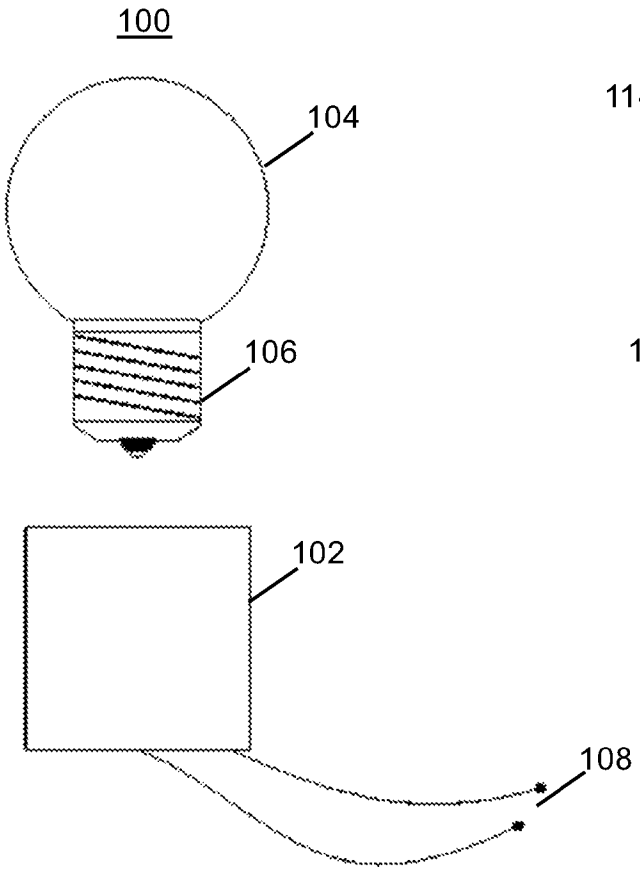
FIG. 1A depicts an exemplary Edison screw light bulb socket and an exemplary Edison screw light bulb.

FIG. 1A depicts an exemplary Edison screw light bulb socket 102 and an exemplary Edison screw light bulb 100. The Edison screw light bulb 100 comprises a glass bulb portion 104 and an electrical male Edison screw base portion 106 that includes an electrical contact for receiving a voltage when placed (screwed) into the Edison screw light bulb socket 102. The electrical contact provides the voltage to a filament (not shown) inside the glass bulb portion 104 causing the light bulb 100 to produce light. The Edison screw light bulb socket 102 receives a voltage 108 from a primary voltage source, for example, a 120 VAC voltage source. One skilled in the art will recognize that all sorts of Edison screw light bulb sockets 102 exist for use in the United States and/or in other countries that receive different voltages (e.g., 240 VAC).

FIG. 1B depicts an exemplary electrical adapter system 110 in accordance with the present invention comprising an electrical adapter 112 and an exemplary electrical fixture 114. The electrical adapter 112 and electrical fixture 114 are connected physically and electrically using a first electrical connector part 116*a* and a second electrical connector part 116*b*. One skilled in the art will recognize that the electrical connection between the first and second electrical connector parts 116*a* 116*b* could be implemented using a plug and socket approach, an Edison screw socket approach, or any other electrical connector approach, whereby wiring, contacts, plugs, and sockets are not shown. Additionally, the shapes of the electrical adapter 112 and the electrical fixture 114 were arbitrarily chosen and can be shaped and sized as appropriate. Furthermore, although a single electrical fixture 114 is shown being attachable to an electrical adapter 112, two or more electrical fixtures 114 could be attachable to a single electrical adapter 112 having multiple first electrical connector parts 116*a* (not shown), where the driver circuitry of the electrical adapter could be configured to supply the same (or different) types of secondary voltage types as required to support the same (or different) voltage requirements of multiple electrical fixtures 114.

FIG. 1C depicts an exemplary electrical outlet 118 having two electrical sockets 120 for receiving electrical plugs (not shown) such as can be found on power cords for common electrical fixtures and electrical appliances including table lamps, televisions, computers, toasters, vacuum cleaners, and the like. One skilled in the art will recognize that the electrical outlet 118 could be a 120 VAC voltage source or any other voltage source available in the United States and/or in other countries (e.g., 240 VAC) and can conform to any of the many well known plug standards including Type A, Type B, Type C, Type D, Type E, Type F, Type E/F hybrid, Type G, Type H, Type I, Type J, Type K, Type L, Type M, or any other desired type.

FIG. 1D depicts a front view of an exemplary electrical adapter system 110 in accordance with the present invention. Instead of an Edison screw light bulb socket 102, the electrical adapter system 110 has a plug 122 able to connect into one of the electrical sockets 120 of the electrical outlet 118 of FIG. 1C.

FIG. 1E depicts a back view of the exemplary electrical adapter system 110 of FIG. 1D, which includes an optional electrical socket 120 enabling a person to connect the electrical adapter system 110 into an electrical socket 120 of an electrical outlet 118 while still providing an electrical socket 120 for receiving a plug such as a power cord for a vacuum cleaner. The electrical socket 120 outputs a voltage based on the primary voltage. For example, the electrical socket 120 may output a voltage with the same voltage as the primary voltage. The optional electrical socket 120 also enables two or more electrical adapter systems 110 to be daisy-chained to an electrical outlet 118. As such, multiple (perhaps different) electrical fixtures can be powered by a single electrical outlet 118.

FIG. 1F depicts a front view of another exemplary electrical adapter system 110 in accordance with the present invention, which is like the electrical adapter system 110 of FIGS. 1D and 1E except the plug 122 is on the bottom of the electrical adapter 112.

FIG. 1G depicts a front view of yet another exemplary electrical adapter system 110 in accordance with the present invention. As shown, the electrical adapter system 110 includes an electrical male Edison screw base portion 106 and an electrical plug 122 enabling the electrical adapter system 110 to be connected to either an Edison light bulb socket 102 or an electrical outlet 118.

FIG. 1H depicts a back view of the exemplary electrical adapter system 110 of FIG. 1G. As shown, the exemplary electrical adapter system 110 includes an optional electrical socket 120 enabling a plug of a device to be connected and/or enables daisy-chaining of multiple electrical adapter systems 110.

FIG. 1I depicts a front view of still another exemplary electrical adapter system 110 in accordance with the present invention that includes a stackable adapter 124. The first electrical connector part is configured to be detachably coupled to the stackable adapter 124. The stackable adapter 124 includes a third electrical connector part configured to be detachably coupled to the first electrical connector part of the electrical adapter and a fourth electrical connector part configured to be detachably coupled to the second electrical connector part of the electrical fixture. The third electrical connector part of the stackable adapter 124 may be identical to the second electrical connector part of the electrical fixture 114. The fourth electrical connector part of the stackable adapter 124 may be identical to the first electrical connector part of the electrical adapter 112.

The stackable adapter 124 is configured to reside between an electrical adapter 112 configured with an electrical plug 122 for connection into an electrical outlet. Alternatively, a stackable adapter 124 can be configured to reside between an electrical adapter 112 configured with an electrical male Edison screw base portion 106 enabling the electrical adapter system 110 to be connected to either an Edison light bulb socket 102. As described in relation to FIGS. 1G and 1H the stackable adapter 124 could be configured to reside between an electrical adapter configured to connect to an electrical outlet 118 or to an Edison light bulb socket 102. Moreover, multiple stackable adapters 120 can be placed between an electrical adapter 112 and an electrical fixture 114.

FIG. 1J depicts a back view of the exemplary electrical adapter system 110 of FIG. 1I having a stackable electrical adapter 124, where both adapters 112 124 include an optional electrical socket 120. One skilled in the art will recognize that all sorts of combinations of electrical adapters 112, stackable adapters 124, and electrical fixtures 114 are possible as configured using various combinations of electrical sockets 120, electrical plugs 122, and electrical male Edison screw base portions 106.

Figure 2A:
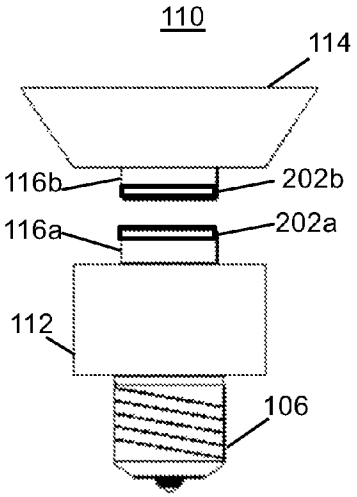
FIG. 2A depicts two exemplary components of a correlated magnetic electrical connector used to magnetically attach and electrically connect the electrical adapter and electrical fixture of an electrical adapter system in accordance with the present invention.

FIG. 2A depicts two exemplary components 202*a* 202*b* of a correlated magnetic electrical connector used to magnetically attach and electrically connect the electrical adapter 112 and electrical fixture 114 of an electrical adapter system 110 in accordance with the present invention. As shown in FIG. 2A, the first electrical connector part 116*a* comprises a first correlated magnetic electrical connector component 202*a* and the second electrical connector part 116*b* comprises a second correlated magnetic electrical connector component 202*b*. As such, the first and second electrical connector parts 116*a* 116*b* serve as housings for and include electrical wiring/circuitry connecting to the respective first and second correlated magnetic electrical connector components 202*a* 202*b*. The first and second correlated magnetic electrical connector components 202*a* 202*b* are configured at or near the surface of the first and second electrical connector parts 116*a* 116*b* enabling them to be magnetically attached by aligning the first and second correlated magnetic electrical connector components 202*a* 202*b* using sideways translational movement. Once the first and second correlated magnetics connector components 202*a* 202*b* are magnetically attached, the electrical adapter 112 and the electrical fixture 114 of the electrical adapter system 110 are electrically connected.

Figure 2B:
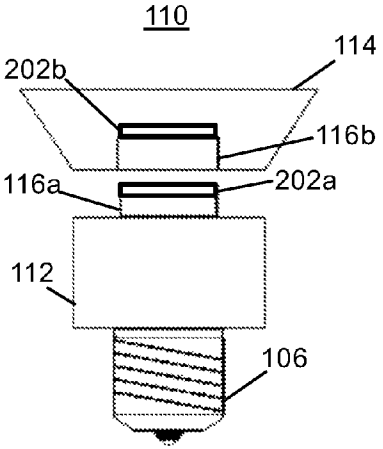
FIG. 2B depicts another two exemplary parts of a correlated magnetic electrical connector used to attach the parts of a electrical adapter system in accordance with the present invention.

FIG. 2B depicts another two exemplary components 202*a* 202*b* of a correlated magnetic electrical connector used to magnetically attach and electrically connect the electrical adapter 112 and electrical fixture 114 of an electrical adapter system 110 in accordance with the present invention. As shown in FIG. 2B, the second electrical connector part 116*b* and second correlated magnetic electrical connector 202*b* are recessed into the electrical fixture 114 to serve as a female portion of a male-female connector, whereby the first electrical connector part 116*a* and first correlated magnetic electrical connector 202*a* serve as the male portion of the male-female connector. Electrical wiring attached to the second correlated magnetic electrical connector 202*b* could reside in the electrical fixture 114 and could reside in the second electrical connector part 116*b* or the second electrical connector part 116*b* could merely act as a housing in which the second correlated magnetic electrical connector 202*b* resides and within which the first electrical connector part 116*a* and first correlated magnetic electrical connector 202*a* are inserted. One skilled in the art will recognized that the male-female connector approach prevents the use of sideways translational movement and instead requires up and down translational movement and (optionally) rotational movement.

Figure 2C:
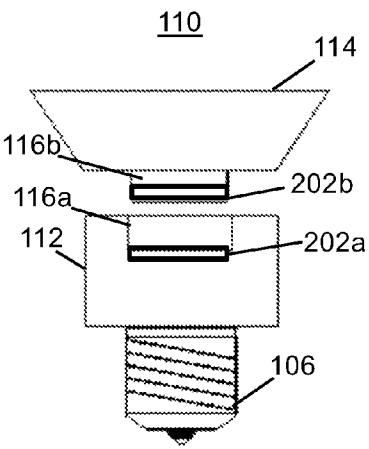
FIG. 2C depicts yet another two exemplary components of a correlated magnetic electrical connector used to attach the parts of a electrical adapter system in accordance with the present invention.

FIG. 2C depicts yet another two exemplary components 202*a* 202*b* of a correlated magnetic electrical connector used to attach the electrical adapter 112 and electrical fixture 114 of an electrical adapter system 110 in accordance with the present invention. As shown in FIG. 2C, the first electrical connector part 116*a* and second correlated magnetic electrical connector 202*a* are recessed into the electrical adapter 112 to serve as a female portion of a male-female connector, whereby the second electrical connector part 116*b* and second correlated magnetic electrical connector 202*b* serve as the male portion of the male-female connector. Electrical wiring attached to the first correlated magnetic electrical connector 202*a* could reside in the electrical adapter 112 and could reside in the first electrical connector part 116*a* or the first electrical connector part 116*a* could merely act as a housing in which the first correlated magnetic electrical connector 202*a* resides and within which the second electrical connector part 116*b* and second correlated magnetic electrical connector 202*b* are inserted.

Figure 2D:
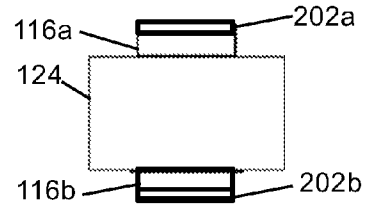
FIG. 2D depicts an exemplary stackable adapter that can be used with the two exemplary components of the correlated magnetic electrical connector of FIG. 2A.

FIG. 2D depicts an exemplary stackable adapter 124 that can be used with the two exemplary components 202*a* 202*b* of the correlated magnetic electrical connector of FIG. 2A. As shown in FIG. 2D, the first component 202*a* of the correlated magnetic electrical connector of the exemplary stackable adapter 124 can connect to the second component 202*b* of the correlated magnetic electrical connector associated with the electrical fixture 114 of the electrical adapter systems 110 of FIGS. 2A-2C. Similarly, the second component 202*b* of the correlated magnetic electrical connector of the exemplary adapter 124 can connect to the first component 202*a* of the correlated magnetic electrical connector of the electrical adapter 112 of the electrical adapter systems 110 of FIGS. 2A-2C. Moreover, multiple stackable adapters 124 can be daisy-chained between an electrical fixture 114 and electrical adapter 112 of an electrical adapter system 110 in accordance with the present invention, whereby the first component 202*a* of the correlated magnetic electrical connector of the a first stackable adapter 124 will connect to the second component 202*b* of the correlated magnetic electrical connector of the second stackable adapter 124, and so on.

Figure 2E:
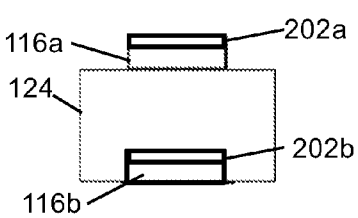
FIG. 2E depicts an exemplary stackable adapter that can be used with the two exemplary components of the correlated magnetic electrical connector of FIG. 2B.

FIG. 2E depicts an exemplary stackable adapter 124 that can be used with the two exemplary components 202*a* 202*b* of the correlated magnetic electrical connector of FIG. 2B. In a manner similar to what has been described in relation to FIG. 2D, one or more stackable adapters 124 such as depicted in FIG. 2E can reside between the electrical adapter 112 and electrical fixture 114 of the electrical adapter systems 110 of FIG. 2A or 2B.

Figure 2F:
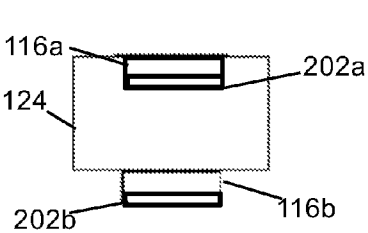
FIG. 2F depicts an exemplary stackable adapter that can be used with the two exemplary components of the correlated magnetic electrical connector of FIG. 2C.

FIG. 2F depicts an exemplary stackable adapter 124 that can be used with the two exemplary components 202*a* 202*b* of the correlated magnetic electrical connector of FIG. 2C. In a manner similar to what has been described in relation to FIG. 2D, one or more stackable adapters 124 such as depicted in FIG. 2F can reside between the electrical adapter 112 and electrical fixture 114 of the electrical adapter systems 110 of FIG. 2A or 2C. An alternative stackable adapter 124 (not shown) could have exemplary components 202*a* 202*b* of a correlated magnetic electrical connector that both function as female portions of a male-female connector that could be used with the electrical adapter system 110 of FIG. 2A.

Figure 3B:
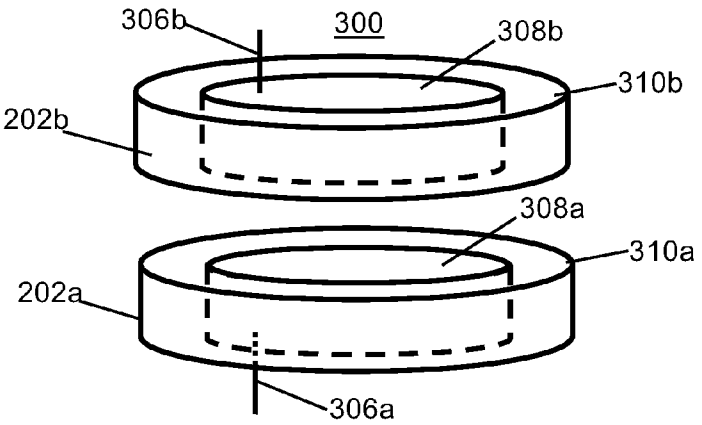
FIG. 3B depicts exemplary circularly-shaped electrical contact portions and exemplary ring-shaped correlated magnetic structure portions of two exemplary components of a correlated magnetic electrical connector in accordance with the present invention.
Figure 3A:
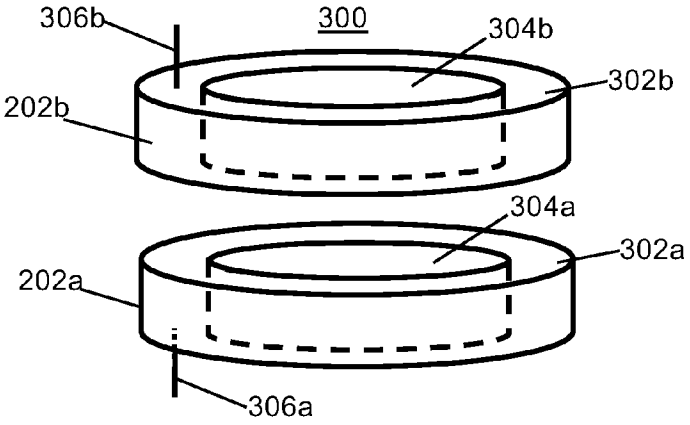
FIG. 3A depicts exemplary ring-shaped electrical contact portions and exemplary circularly-shaped correlated magnetic structure portions of two exemplary components of a correlated magnetic electrical connector in accordance with the present invention.

FIG. 3A depicts exemplary ring-shaped electrical contact portions 302*a* 302*b* and exemplary circularly-shaped correlated magnetic structure portions 304*a* 304*b* of two exemplary components 202*a* 202*b* of a correlated magnetic electrical connector 300 in accordance with the present invention. As shown, electrical cables 306*a* 306*b* are connected to the ring-shaped electrical contact portions 302*a* 302*b*, respectively.

FIG. 3B depicts exemplary circularly-shaped electrical contact portions 308*a* 308*b* and exemplary ring-shaped correlated magnetic structure portions 310*a* 310*b* of two exemplary components 202*a* 202*b* of a correlated magnetic electrical connector 300 in accordance with the present invention. As shown, electrical cables 306*a* 306*b* are connected to the circularly-shaped electrical contact portions 308*a* 308*b*, respectively.

Figure 3D:
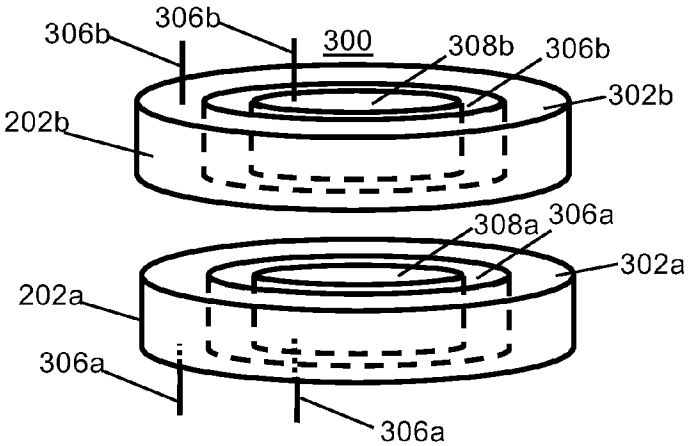
FIG. 3D depicts exemplary ring-shaped and circularly-shaped electrical contact portions and exemplary ring-shaped correlated magnetic structure portions of two exemplary components of a correlated magnetic electrical connector in accordance with the present invention.
Figure 3C:
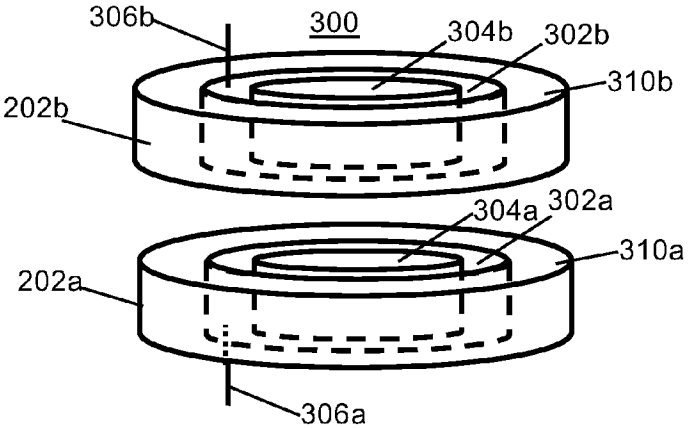
FIG. 3C depicts exemplary ring-shaped electrical contact portions and exemplary circularly-shaped and ring-shaped correlated magnetic structure portions of two exemplary components of a correlated magnetic electrical connector in accordance with the present invention.

FIG. 3C depicts exemplary ring-shaped electrical contact portions 302*a* 302*b* and exemplary circularly-shaped 304*a* 304*b* and ring-shaped 310*a* 310*b* correlated magnetic structure portions of two exemplary components 202*a* 202*b* of a correlated magnetic electrical connector 300 in accordance with the present invention. As shown, electrical cables 306*a* 306*b* are connected to the ring-shaped electrical contact portions 302*a* 302*b*, respectively.

FIG. 3D depicts exemplary ring-shaped electrical contact portions 306*a* 306*b* and circularly-shaped electrical contact portions 302*a* 302*b* and exemplary ring-shaped correlated magnetic structure portions 306*a* 306*b* of two exemplary components 202*a* 202*b* of a correlated magnetic electrical connector 300 in accordance with the present invention. As shown, electrical cables 306*a* 306*b* are connected to the ring-shaped electrical contact portions 302*a* 302*b*, respectively, and to the circularly-shaped electrical contact portions 308*a* 308*b*, respectively.

Figure 4A:
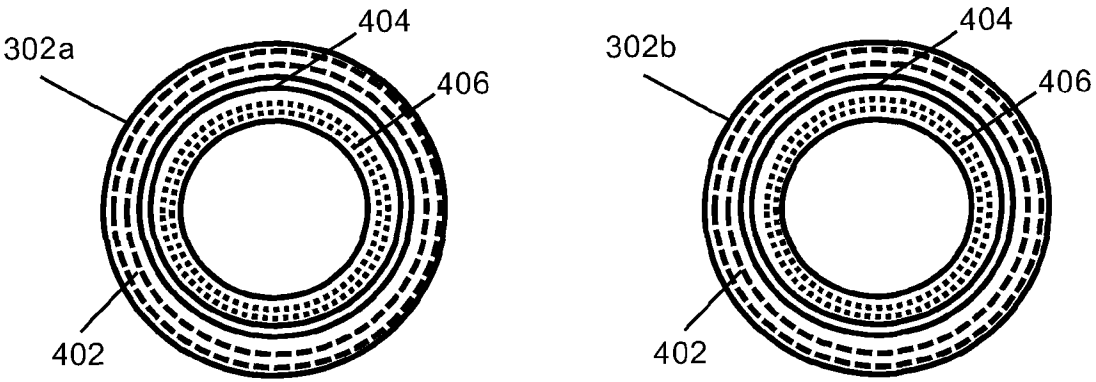
FIG. 4A depicts exemplary electrical contacts of exemplary ring-shaped electrical portions of two exemplary components of a correlated magnetic electrical connector in accordance with the present invention.

FIG. 4A depicts exemplary electrical contacts 402 404 406 of exemplary ring-shaped electrical portions of two exemplary components 302*a* 302*b* of a correlated magnetic electrical connector 300 in accordance with the present invention. As shown in FIG. 4A, outermost ring-shaped electrical portions 402 indicated by two dashed circular lines surround middle ring-shaped electrical portions 404 indicated by two solid circular lines that surround the innermost ring-shaped electrical portions 406 indicated by two dotted circular lines. As such, when the two components 302*a* 302*b* are aligned and in contact, there corresponding electrical contact portions 402 404 406 become in contact providing three separate electrical connections, which could be used for example for power, ground, and communications. Generally, to practice the invention, at least two electrical contact portions are required to provide power and ground connectivity but one or more additional electrical contact portions can also be used for other purposes (e.g., for communications, to provide a control signal, or to provide a data signal). Communications connectivity may be used, for example, to identify to an electrical adapter the type of electrical fixture that has been connected to it (or vice versa), to provide sensor information, to provide control signals, etc. Alternatively, two or more electrical contact portions could be used to provide two or more different types of electrical power (e.g., different voltages).

Figure 4B:
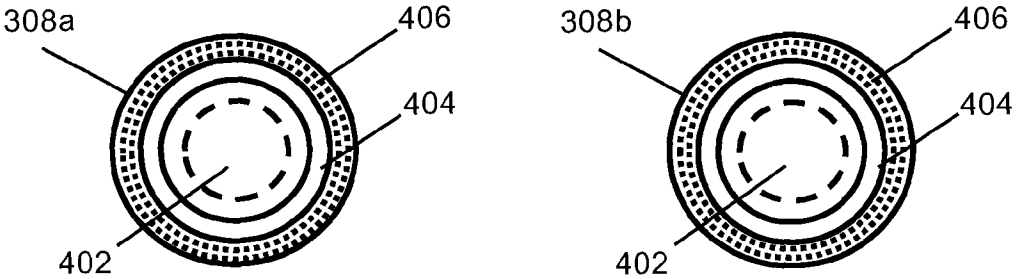
FIG. 4B depicts exemplary electrical contacts of exemplary circularly-shaped electrical portions of two exemplary components of a correlated magnetic electrical connector in accordance with the present invention.

FIG. 4B depicts exemplary electrical contacts of exemplary circularly-shaped electrical portions of two exemplary components of a correlated magnetic electrical connector in accordance with the present invention. As with the electrical contacts of FIG. 4A, three different contact portions 402 404 406 are shown, which might correspond (in no particular order) to communications, power, and ground. As described in relation to FIG. 4A, all sorts of combinations are possible including multiple power connections for supplying different voltages, and so forth.

Figure 5A:
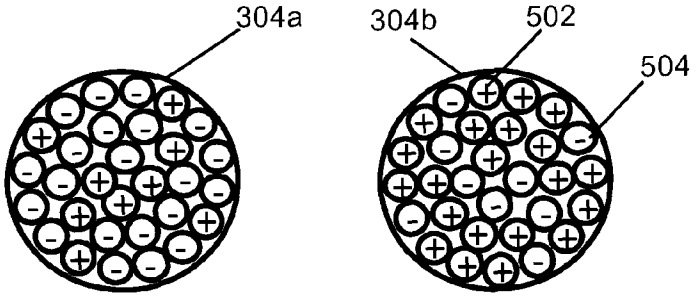
FIG. 5A depicts exemplary circularly-shaped complementary correlated magnetic structure portions of two exemplary components of a correlated magnetic electrical connector in accordance with the present invention.

FIG. 5A depicts exemplary circularly-shaped complementary correlated magnetic structure portions 304*a* 304*b* of two exemplary components of a correlated magnetic electrical connector 300 in accordance with the present invention. As shown in FIG. 5A, the correlated magnetic structure portions 304*a* 304*b* have complementary (i.e., mirror image) patterns of positive maxels 502 and negative maxels 504. The specific patterns used for the magnetic structure portions 304*a* 304*b* of a correlated magnetic electrical connector 300 can be selected to have only one rotational alignment where the maxels will all correlate. Alternatively, they may be coded to allow several different correlated positions (e.g., every 60 degrees). The coding pattern used in FIG. 5A comprises three concentric circles of maxels with the outer circle corresponding to four Barker 4 code modulos, the middle circle corresponding to two Barker 5 code modulos, and the innermost circle corresponding to a complementary Barker 4 code modulo.

Figure 5B:
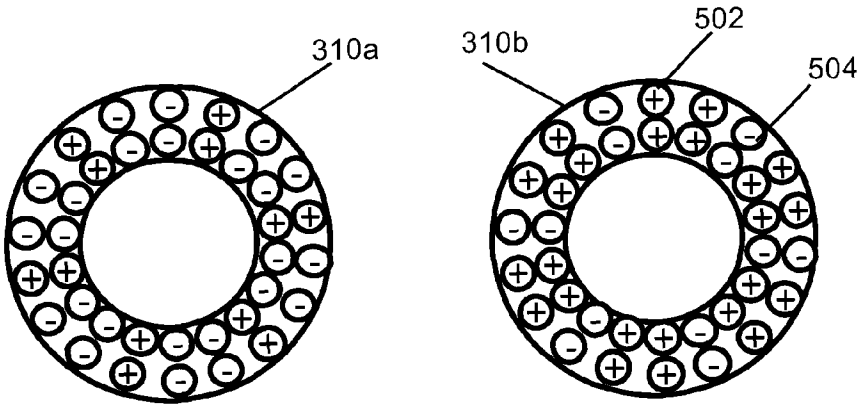
FIG. 5B depicts exemplary ring-shaped complementary correlated magnetic structure portions of two exemplary components of a correlated magnetic electrical connector in accordance with the present invention.

FIG. 5B depicts exemplary ring-shaped complementary correlated magnetic structure portions 310*a* 310*b* of two exemplary components of a correlated magnetic electrical connector 300 in accordance with the present invention. As shown in FIG. 5B, the correlated magnetic structure portions 310*a* 310*b* have complementary (i.e., mirror image) patterns of positive maxels 502 and negative maxels 504. As with the correlated magnetic portions 304*a* 304*b* of FIG. 5A, the specific patterns used for the magnetic structure portions 310*a* 310*b* of a correlated magnetic electrical connector 300 of FIG. 5B can be selected to have only one rotational alignment where the maxels will all correlate or they may be coded to allow several different fully or partially correlated positions. The coding may cause certain rotational alignments where a repel force is produced. Generally, all sorts of magnetic behaviors can be prescribed using correlated magnetics coding techniques. The coding pattern used in FIG. 5B comprises two concentric circles of maxels oriented in a radial pattern, where the two concentric circles each correspond to six code modulos of a Barker 3 code.

Figure 5C:
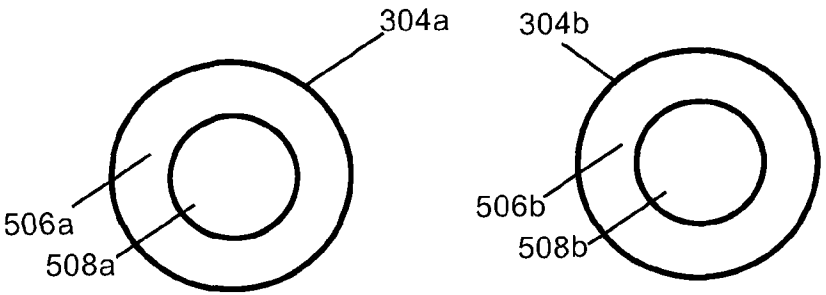
FIG. 5C depicts another exemplary circularly-shaped multi-level correlated magnetic structure portions of two exemplary components of a correlated magnetic electrical connector in accordance with the present invention.
Figure 5D:
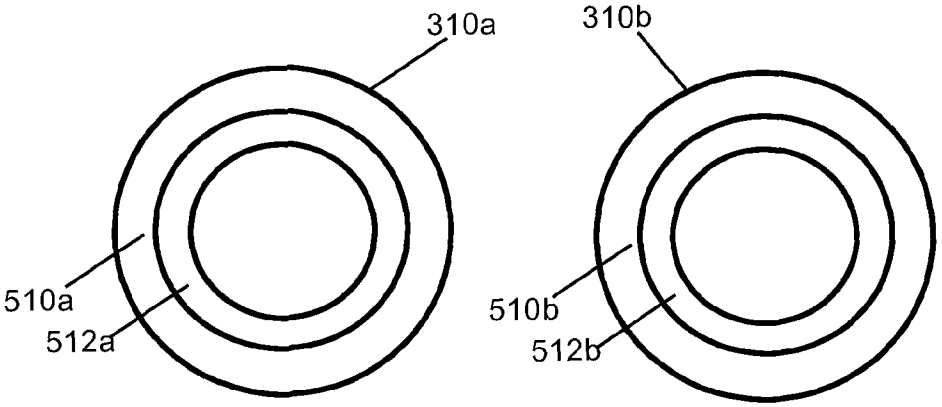
FIG. 5D depicts exemplary ring-shaped multi-level correlated magnetic structure portions of two exemplary components of a correlated magnetic electrical connector in accordance with the present invention.

FIGS. 5C and 5D are representative of the use of multi-level correlated magnetic structures as the correlated magnetic structure portions of a correlated magnetic electrical connector. Multi-level correlated magnetic structures are described in U.S. patent application Ser. No. 12/885,450, filed Sep. 18, 2010, which is incorporated herein by reference. Generally, such multi-level correlated structures have first and second regions the produce different force vs. distance characteristics that combine to cause magnetic forces that transition from an attract state to a repel state depending on the distance the structures are separated.

FIG. 5C depicts exemplary circularly-shaped multi-level correlated magnetic structure portions 304*a* 304*b* of two exemplary components of a correlated magnetic electrical connector 300 in accordance with the present invention. As shown, the first circularly-shaped multi-level correlated magnetic structure portion 304*a* comprises a first region 506*a* and a second region 508*a* and the second circularly-shaped multi-level correlated magnetic structure portion 304*b* also comprises a first region 506*b* and a second region 508*b* that interact with the two regions 506*a* 508*a* of the first circularly-shaped multi-level correlated magnetic structure portion 304*a* to produce multi-level magnetism. As shown, the two first regions 506*a* 506*b* are ring-shaped and the second regions 508*a* 508*b* are circularly-shaped. Many other shapes of two or more regions could also be employed to produce multi-level magnetism.

FIG. 5D depicts exemplary ring-shaped multi-level correlated magnetic structure portions of two exemplary components of a correlated magnetic electrical connector in accordance with the present invention. As shown, the first ring-shaped multi-level correlated magnetic structure portion 310*a* comprises a first region 510*a* and a second region 512*a* and the second ring-shaped multi-level correlated magnetic structure portion 310*b* also comprises a first region 510*b* and a second region 512*b* that interact with the two regions 510*a* 512*a* of the first ring-shaped multi-level correlated magnetic structure portion 310*a* to produce multi-level magnetism. As shown, the two first regions 510*a* 512*b* are ring-shaped and the second regions 510*a* 512*b* are ring-shaped. Many other shapes of two or more regions could also be employed to produce multi-level magnetism.

Although, the exemplary connectors and associated magnetic structures have been described herein as being circularly-shaped and ring-shaped, one skilled in the art will recognize that other shapes including square, rectangular, or any other desired shape could be employed in accordance with the invention.

In accordance with another aspect of the invention, one or more stackable adapters 124 of an electrical adapter system 110 can provide a location what could be described as a form of intelligence. For example, one or more stackable adapters 124 may detect or sense a condition, may 'listen to' or 'speak to' a person, or may communicate with one or more other stackable adapters 124 of one or more other electrical adapter systems 110 located at one or more other locations. As such, electrical adapter system 110 having stackable adapters 12409 that provide such intelligence functions can be referred to as intelligence function nodes (or smart nodes) 600.

Figure 6B:
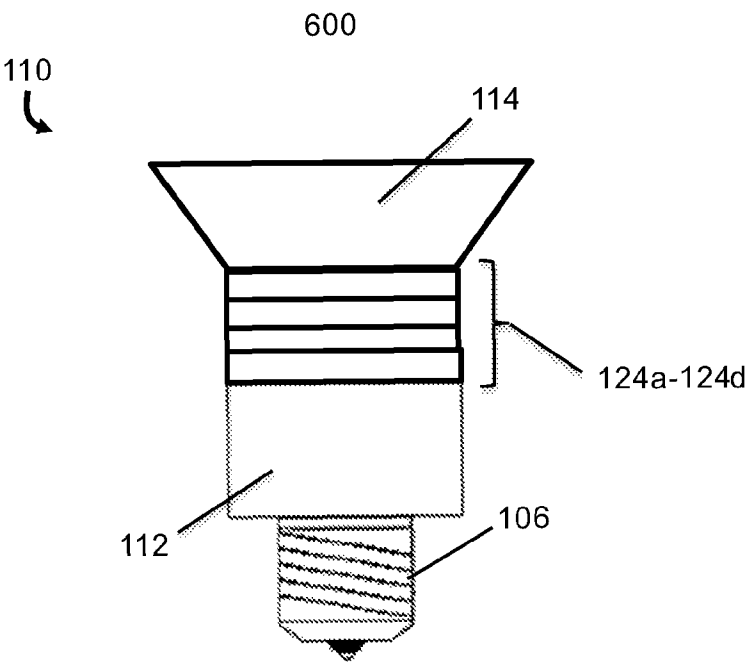
FIG. 6B depicts another exemplary electrical adapter system configured to be an exemplary smart node in accordance with the present invention.
Figure 6A:
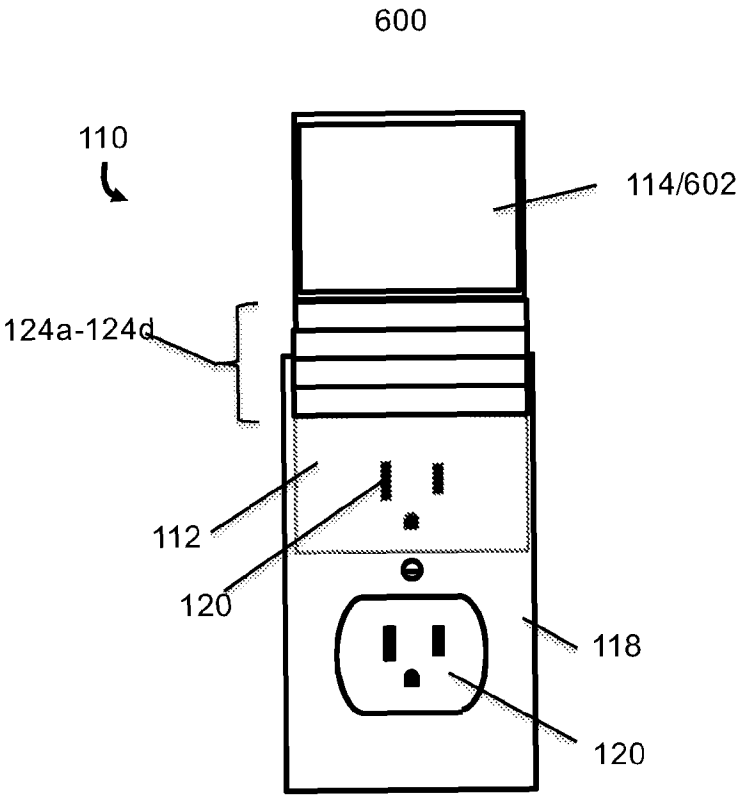
FIG. 6A depicts an exemplary electrical adapter system configured to be an exemplary smart node in accordance with the present invention.

FIG. 6A depicts an exemplary electrical adapter system 100 configured to be a first exemplary smart node 600. Referring to FIG. 6A, the first smart node 600 comprises an electrical adapter 112 configured to plug into an electrical outlet 118. The electrical adapter 112 includes an optional electrical outlet 120 enabling another device to be plugged into the electrical adapter. Stacked on top of the electrical adapter 112 are four stackable adapters 124*a*-124*d*, which may correspond to four intelligence functions: audio input, audio output, motion sensing, and wireless network communications. The audio input function can be provided by a microphone that enables voice commands for controlling smart home functions using voice recognition technology. The audio output function can be provided by a speaker that enables synthesized or recorded voice responses and general information. Multiple speakers in multiple nodes can provide stereo sound. The motion sensing function enables motion based control of lighting, security/safety features, etc. The wireless network communications function enables smart node-to-smart node communications as well as communications between smart nodes and one or more control systems such as might reside on a computer, smart phone, tablet, or watch.

The four stackable adapters 124*a*-124*d* are configured between the electrical adapter 112 and an electrical appliance 114 that is a display 602, for example a flat panel LED display. The display 602 enables video data to be displayed at a location, which may be data provided to an electrical adapter via a communications link or could be video captured by an electrical adapter providing a video recording function. The display 602 may also display other forms of information such as text, icons, or the other graphics and can also function as an input device (e.g., a touch display). Alternatively, a display 602 might be a stackable adapter 124. Having such displays at certain locations of a home would provide visual feedback for a variety of functions, for example, showing who is at the front door or the output of a video surveillance camera of interest. One skilled in the art will understand that the four intelligence functions could be integrated into less than four stackable adapters, for example, a single stackable adapter, and that stackable adapters that provide intelligence functions can be used with stackable adapters that provide other non-intelligence functions, for example, a backup power source (e.g., battery) or data storage function.

FIG. 6B depicts a second exemplary smart node 600. Referring to FIG. 6B, the second smart node 600 comprises an electrical adapter 112 having an electrical male Edison screw base portion 106 configured to be placed (screwed) into an Edison screw light bulb socket 102 (not shown). As with the first smart node 600, stacked on top of the electrical adapter 112 are four stackable adapters 124*a*-124*d*, which may correspond to four intelligence functions: audio input, audio output, motion sensing, and wireless network communications. The four stackable adapters 124*a*-124*d* are configured between the electrical adapter 112 and an electrical appliance 114, which could be, for example, a LED lamp.

In accordance with the invention, smart nodes enable electrical outlets and Edison screw sockets of lamps and lighting fixtures to be converted into a mesh network that can substantially extend the utility of home automation system, for example, allowing use of voice commands from substantially anywhere inside a home. A mesh network of smart nodes, or smart node network, can be configured to receive voice commands from practically any location inside a home and at certain outside locations, which can be conveyed to a control system controlling home (or business) automation. A mesh network of smart nodes can also perform and enable many other functions such as security monitoring, person tracking, and data communications for purposes other than home/business automation.

Generally, smart nodes can be integrated with selected outlet, light fixtures, and lamps to provide multiple layers of coverage of the volume of a home (or business). A typical home has outlets throughout located ~18" above floors and ~6" above counters. A typical home has light fixtures located on ceilings or on walls a few feet below ceilings. Table lamps provide lighting at a level about half way between the level of outlets and the level of lights, which are closer to where a person may be sitting in a chair and thus provide ideal locations for microphones. Each of these locations provides an opportunity to locate a smart node to meet user requirements. Smart nodes integrated with outlets would typically be always powered, where sensors can optionally be used to turn functions on and off. Smart nodes integrated with lights and lamps can be configured to be switched off along with the lights or an associated light can be turned on and off independently (e.g., using a remote control, voice command, etc.).

Figure 7:
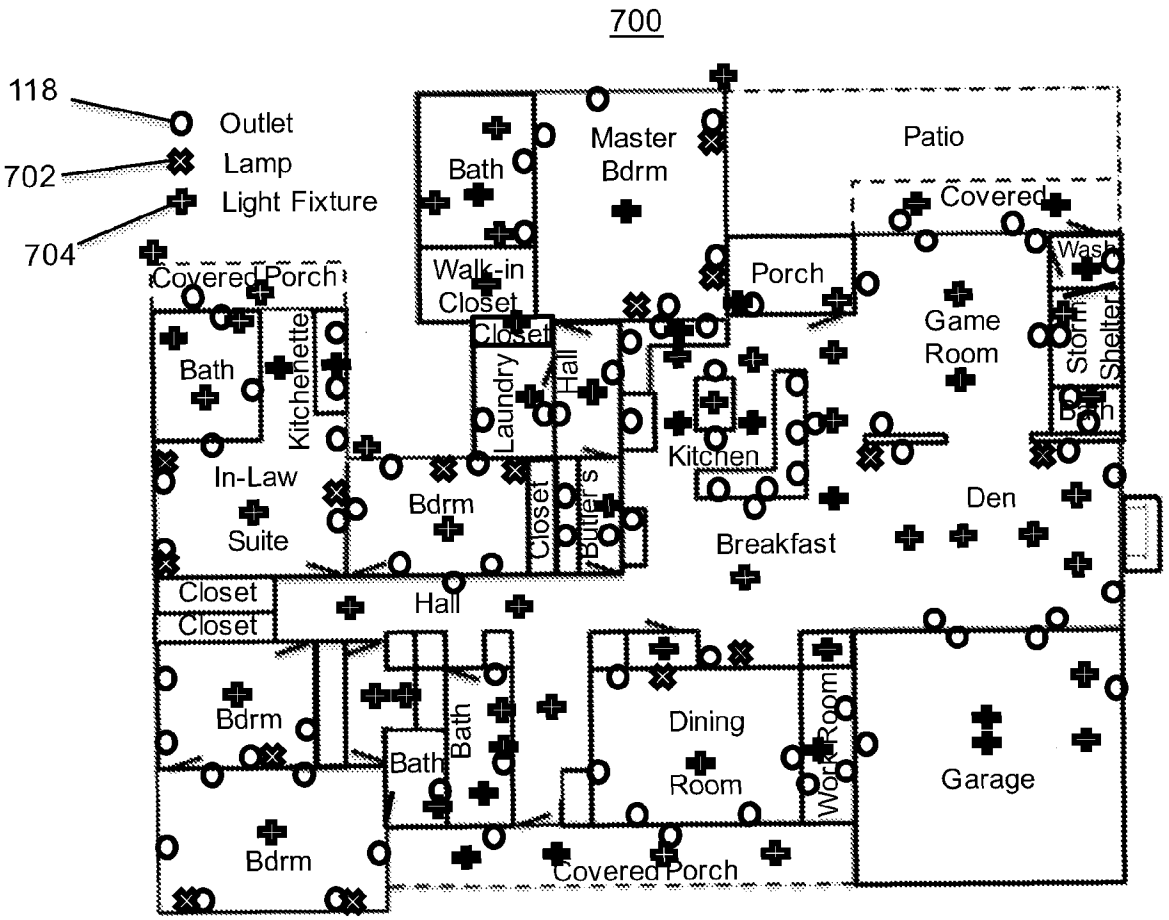
FIG. 7 depicts an exemplary house floor plan.

FIG. 7 depicts an exemplary house floor plan 700 and exemplary locations of outlets 118, lamps 702, and light fixtures 704 relative to the house floor plan 700. Outlets 118 are represented by 'O' symbols, lamps 702 are represented by 'X' symbols, and light fixtures 704 are represented by '+' symbols. Each of the outlets 118, lamps 702, and light FIG. 704 can be configured to include a smart node 600 having various functions, which can be the same or different at different smart nodes and which together form a smart node network.

Smart node networks provide a paradigm shift for home and office automation products. Currently, providers of electronic devices (i.e., smoke detectors, network repeaters, etc.) typically include power conversion circuitry to convert 120 VAC to some lower power in each device. Stackable adapters can share the cost of power conversion required to provide a secondary power source at a given smart node location, where cost savings increases with the number of adapters (i.e., devices) in a given smart node (e.g., four stackable adapters (i.e., devices) sharing a secondary power source=~75% cost savings). A smart node network can substantially reduce the cost of providing functions (e.g., voice recognition, network coverage, etc.) since inexpensive smart nodes can share costs and functionality as opposed to being separate devices. Stackable adapters can also share data signals so that they can work together and work with nearby products. The stackable adapter technology enables development of a secondary power source standard and device control data standard enabling reduced cost and size of products while substantially increasing their utility. Power converter adapter costs should decrease with scale and smart node networks should speed adoption of home/office automation.

A smart node network can be used with Wi-Fi home, local and wide area network systems and Wi-Fi-enabled products, which depend on the products being within range of a wireless router or other Wi-Fi-enabled product. Smart nodes can be used to provide a dense network of low cost WiFi-enabled nodes that can eliminate network bottlenecks and substantially improve accessibility and bandwidth, where a cell phone or other devices can link to any Wi-Fi-enabled node. Smart nodes can be used to enable iBeacon-type systems that track smartphones. Generally, smart nodes provide more network nodes to a Wi-Fi network and provide more paths around obstructions and thereby extend Wi-Fi connectivity to almost any location within a home or business.

A smart node network can be used with power line network (PLN) systems, which involve PLN adapter products that plug into standard power outlets in order to use a home's or business' power lines as a network backbone. Power line adapters are used in combination with Ethernet and AV/HDMI cables to provide communications between devices plugged into the power outlets and devices to which they are connected via a wire or wirelessly. PLNs are being used to enable building management systems. In accordance with one aspect of the invention, a smart node can be configured to provide the same functionality as a PLN adapter, which can be plugged into a standard power outlet or a Edison screw socket. As such, smart node can be used integrated with PLN systems to extend network functionality and further enable robust building management systems. Moreover, the ability to use wireless or wired capabilities between smart nodes allows bridging between a first circuit branch to another branch via the wireless node-to-node connection to avoid having to go through circuit breakers, which can be problematic to PLN systems.

A smart node network can be used to provide improved home/business security/automation systems. Currently, providers of home/business security/automation systems offer assortments of products that somewhat work together but are mainly separate devices that are either battery-powered or have a power conversion circuit, where often wiring must be run to devices as part of an expensive installation. For example, a product line by SimpliSafe™ includes a base state, carbon monoxide detector, smoke detector, control panel, siren, key remote, entry sensor, motion sensor, panic button, freeze sensor, and water sensor that are separate devices powered independently from each other. Such systems typically provide infrared motion detectors that determine movement within an area but require line-of-sight to function. Such motion detectors can detect a burglar to set off an alarm and can also be used to control lighting or otherwise control some form automated function. Stackable adapters and smart node networks enable a relatively inexpensive radar network system that can track the locations of persons inside a home or office without requiring line-of-sight, which provides for much higher levels of security and automation.

Figure 8:
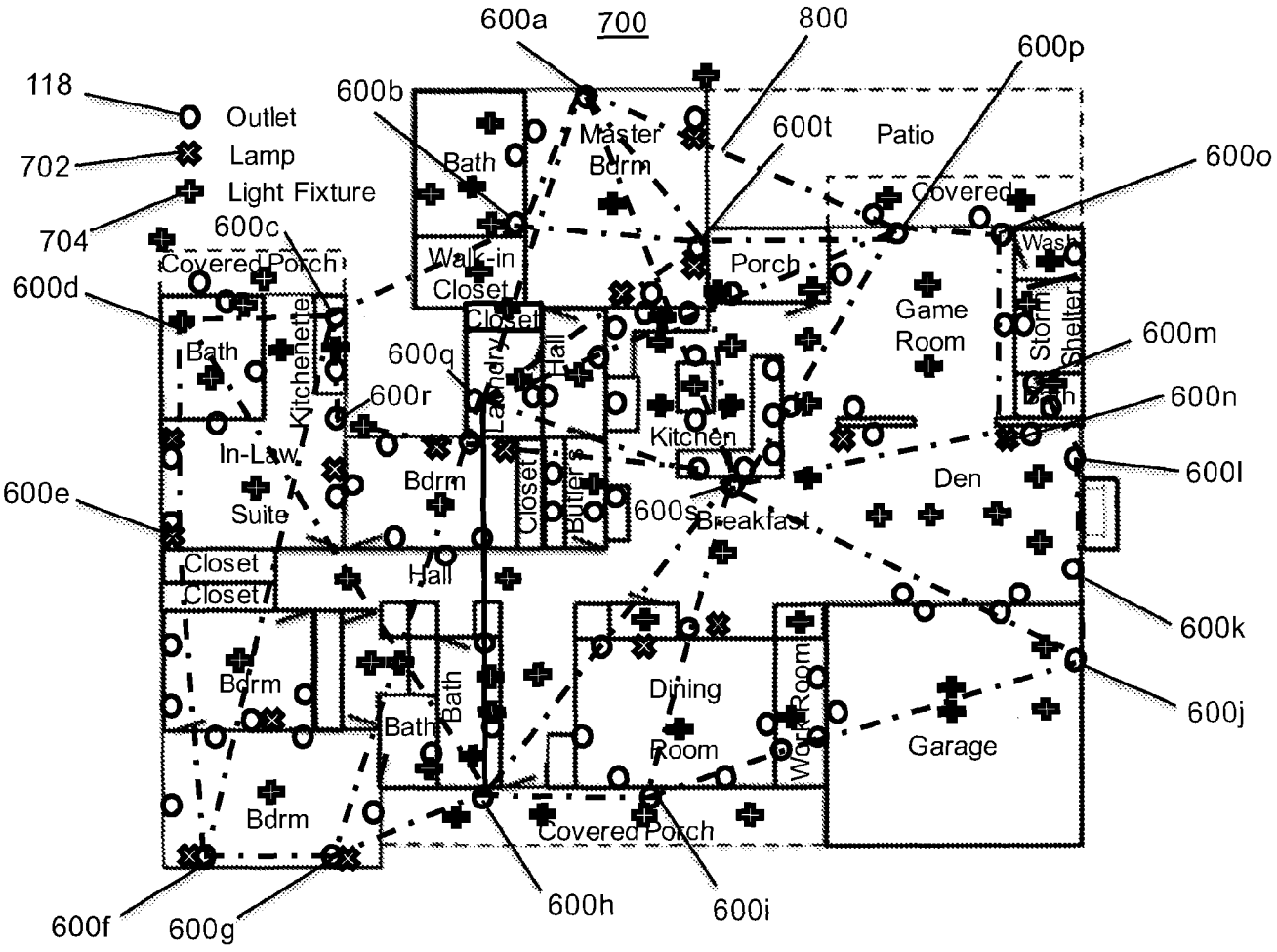
FIG. 8 depicts an exemplary smart node network configured to function as a radar network system.

FIG. 8 depicts the exemplary floor plan 700 of FIG. 7 and an exemplary smart node network 800 configured to function as a radar network system. Referring to FIG. 8, the smart node network 800 consists of smart nodes 600*a*-600*r* located at outlets 118, lamps 702, and light fixtures 704 spaced around the perimeter of the floor plan 700. The network also consists of smart nodes 600*s* and 600*t* that are shown interfacing with multiple smart nodes around the perimeter as indicated by the dot-dash lines.

Generally, smart node networks made radar and tag-based tracking systems more affordable and more useful. Sharing power down conversion costs and leveraging existing wiring infrastructure enables use of more RF transmitters, receivers, and transceivers.

A radar (e.g., UWB radar) tracking system can involve transceivers that send a signal and receive a return signal returning off of objects, where processing of the return signal can detect movement and therefore presence of an object at a given range. This is referred to as monostatic radar proximity detection.

A radar tracking system can include combinations of transmitters, receivers, and/or transceivers that work together to produce a bi-static radar array, where the precise three-dimensional location of a person or animal moving through a building can be tracked in real-time.

Radar tracking systems can be configured to recognize an outer perimeter of a building and the characteristics of rooms (e.g., door and window locations) within a building for security and automation purposes.

RFID Tags can be placed on objects, people, or animals so they can be tracked within or near a building.

Generally, a smart node network can be configured for all sorts of radar and real-time location system (RTLS) applications, where a network of radars can use monostatic and/or bi-static range detection to precisely track movement in three dimensions and/or a network of receivers can track RFID tags associated with object.

Figure 9:
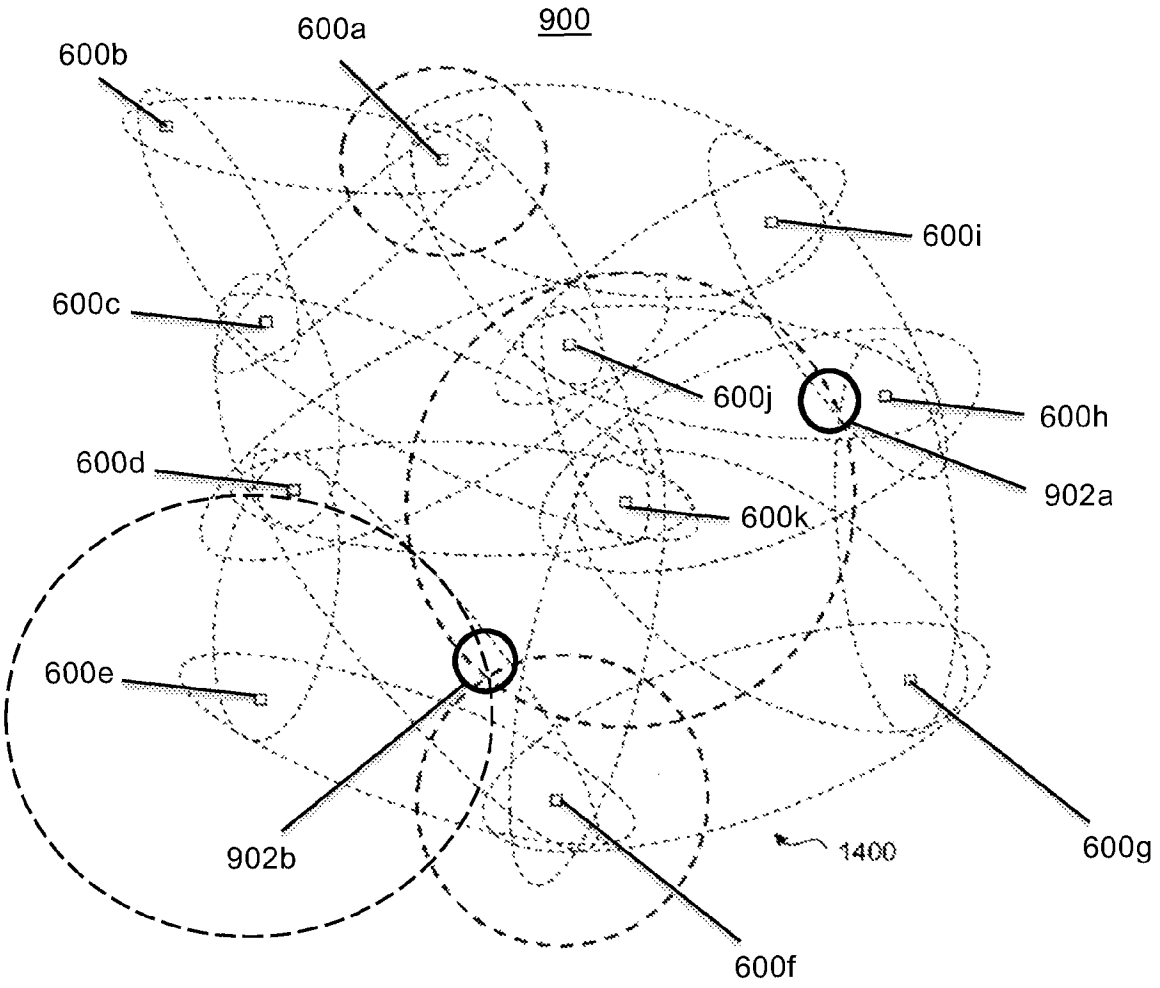
FIG. 9 depicts an exemplary ultra-wideband radar network system.

FIG. 9 depicts an exemplary ultra-wideband (UWB) radar network system 900 comprising a plurality of UWB radar devices included as part of a network of smart nodes 600*a*-600*k*. As shown in FIG. 9, certain individual UWB radar devices may function as monostatic radars as indicated by the dashed circles and certain combinations of two UWB radar devices may function as bi-static radars as indicated by the dashed ovals, which alone or in combination can be used to detect the presence of and track the location of moving objects within an environment, for example, persons 902*a* and 902*b* indicated by the circles produced with solid lines. Such UWB radar systems and network systems are described in U.S. Pat. No. 7,592,944, which is incorporated by reference herein in its entirety.

Smart node networks can use radar techniques that utilize discontinuities of wiring infrastructure. Similar to power line network technology, power line radar technology enables a home's wiring infrastructure and associated impedance discontinuities (outlets, switches, lamps, etc.) to be used as transmitters and receivers. A signal from a signal source travels through wiring (e.g., Romex) and associated signals are emitted from all discontinuities associated with the wiring, which can be received at the signal source and at other receiver locations such that monostatic and bi-static radar techniques can track objects. The use of discontinuities of a wiring infrastructure in a building as transmitters and receivers of a power line radar system is described in U.S. Pat. No. 7,256,727, which is incorporated by reference herein in its entirety.

Figure 10:
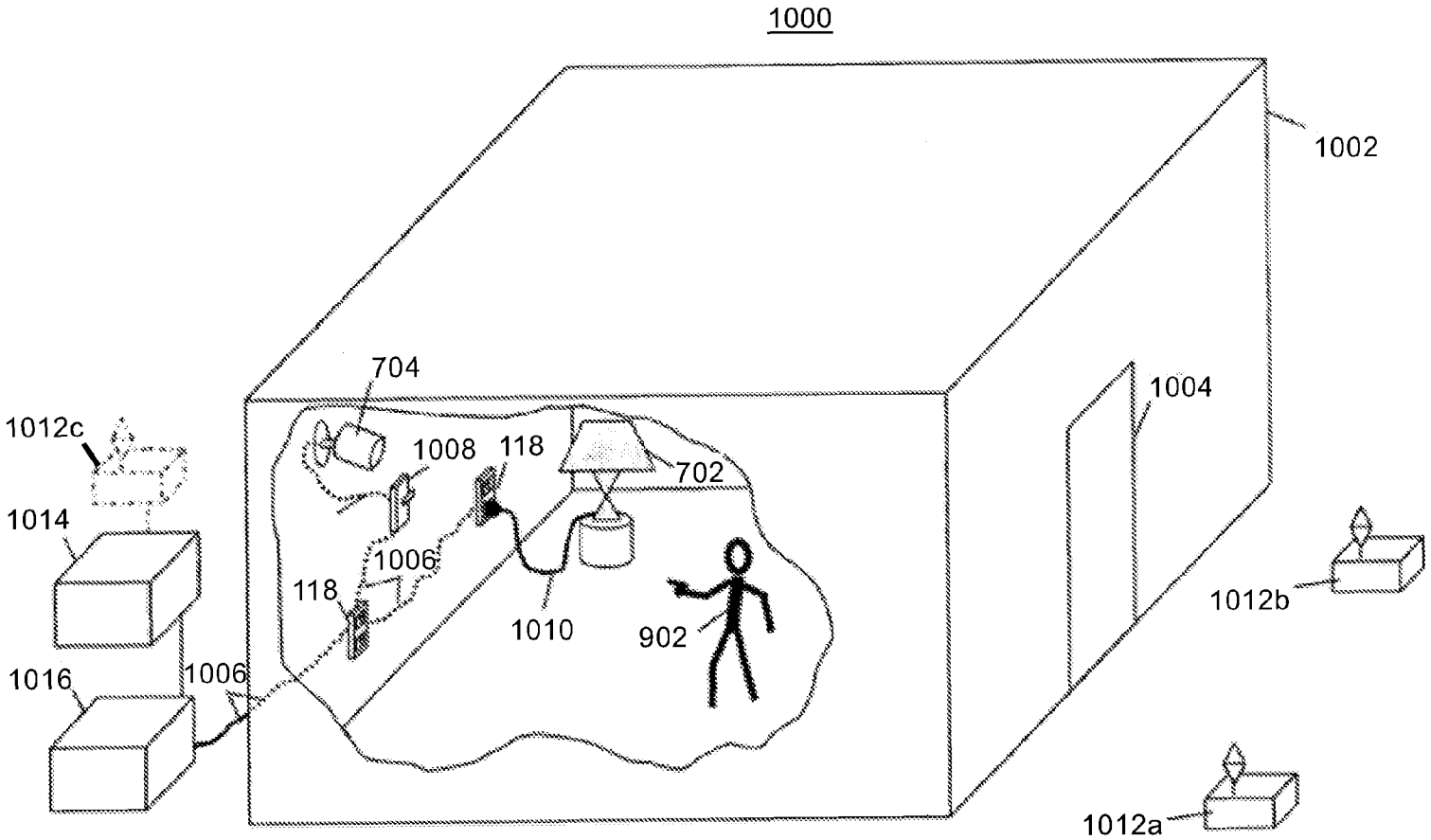
FIG. 10 depicts an exemplary power line radar system.

FIG. 10 depicts a cutaway allowing one to view inside a building 1002 in order to describe a power line radar system. The building 1002 includes various types of utility transmission lines 1006 that are used to provide a public or private type of utility. For example, the building 1002 may contain girders, metal duct work, piping, electrical wiring, and other RF conductive materials that comprise utility transmission lines. Examples of transmission lines in a public utility service include electrical wiring, telephone wiring, cable wiring, etc. Examples of transmission lines in a private utility service include audio/visual wiring, local area network (LAN) wiring, private branch exchange (PBX) wiring, and other RF conductive materials including girders, piping, metal duct work, etc. A power line radar system can be used in any type of environment, such as any arbitrarily shaped building, with any configuration of doors, windows, interior walls, wiring, piping, etc.

Utility transmission lines comprise a conductive portion along which an applied RF waves propagates. Utility service transmission lines also include one or more impedance discontinuities along their path that causes emission of at least a portion of the applied RF waveform, when the waveform encounters a discontinuity. At the discontinuity, part of the RF waveform is emitted, and part of the RF waveform is reflected back from which it came. As such any discontinuity along a utility transmission line comprises an emission point for radiating applied RF waveforms. Discontinuities along the utility transmission line can also be used as reception points.

As shown in FIG. 10, a utility transmission line 1006, comprising the electrical wiring of the building 1002, connects to electrical outlets 118, switch 1008, and light fixture 704 for providing electrical power utility to the building 1002. The utility transmission line 1006 also provided electrical power to a lamp 702, which is plugged into an outlet 118 via an electrical cord 1010. The electrical wiring functions as the utility transmission line 1006, and the electrical outlets 118, switch 1008, light fixture 704, and lamp 702 are all examples of discontinuities along the utility transmission line. Other examples of discontinuities include ceiling lights, motors, control systems, and resistance heating. Still another example comprises transformers that are used for electrical power distribution along power lines. Consequently, an applied RF waveform, for example, a Gaussian pulse generated by the RF waveform generator 1016 would propagate along the utility transmission line 1006 and be emitted at emission points defined by any encountered discontinuities, such as the outlets 118, switch 1008, lamp 702, and fixture 704. Also shown in FIG. 10, are UWB radar transceivers 1012*a*-1012*c*, a processor 1014, and a person 902.

Figure 11:
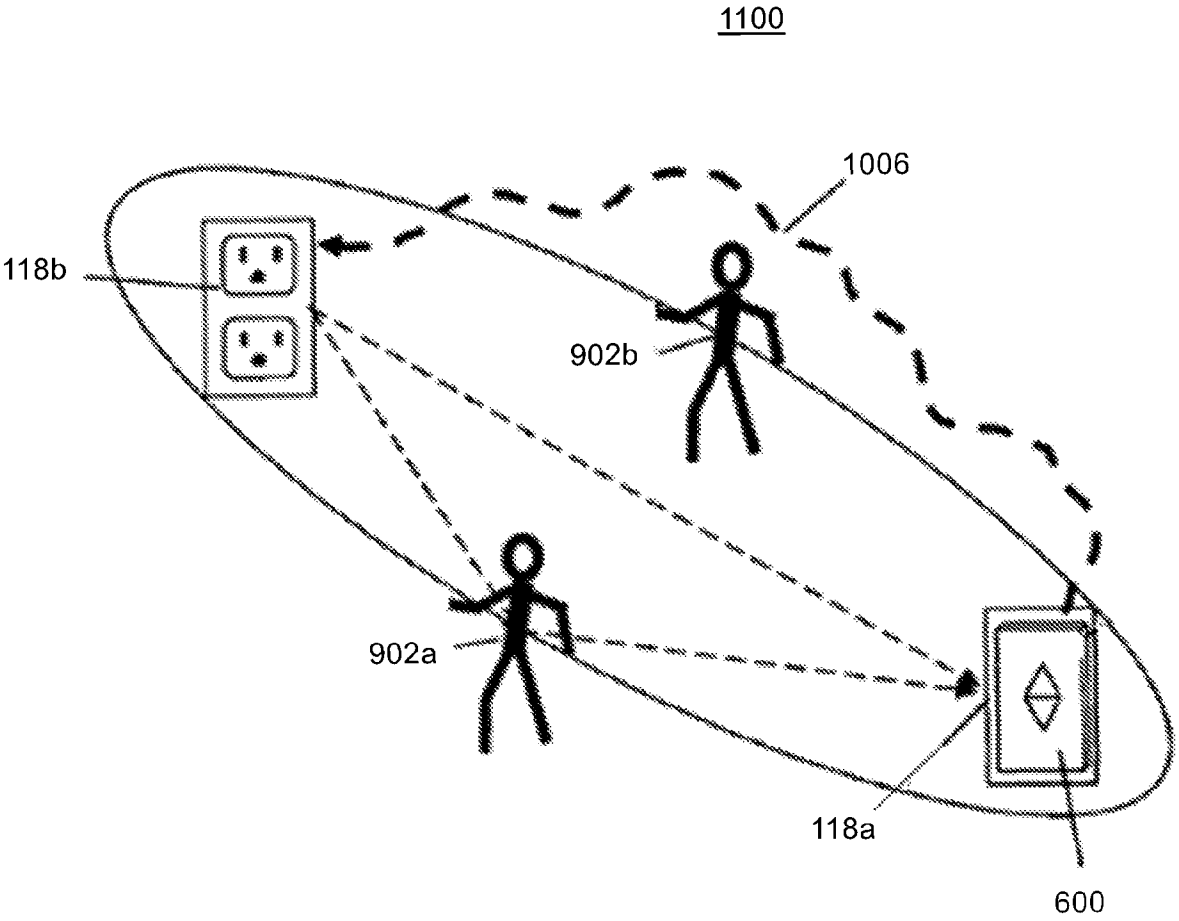
FIG. 11 depicts an exemplary power line bi-static radar system.

FIG. 11 depicts an exemplary power line bi-static radar system 1100 where a smart node 600 plugged into a first outlet 118*a* includes a UWB transmitter that transmits a pulse down transmission line 1006 to a second outlet 118*b*, which emits a pulse having a direct path to the first outlet 118*a* and having a second path that involve reflecting off a first person 902*a*. The two different paths enable differential time of arrival techniques to be used to determine the range to the first person 902*a*.

A smart node network enables all sorts of home automation scenarios. For example, a person cooking in the kitchen could request ingredients of a recipe, where the request could be recognized, the ingredients determined, and then conveyed to the person (e.g., using a computer generated voice).

A person could order takeout food while sitting in their lounge chair and when a delivery person arrives with the food, the person could see the delivery person by viewing a display on a nearby smart node, and know to go to the door to get the food or even provide directions to the delivery person to bring the food into the home. Similarly, the video of the delivery person could be shown on a television or computer monitor.

A person could use voice commands throughout the home to open and close windows and doors, opening and closing blinds, turning on and off fans, controlling fan speed, controlling an oven, etc.

Lamps can have power but not turn on unless movement is detected by a motion sensor and/or darkness is indicated by a light sensor.

Thought technology can be integrated with smart nodes, which may involve various sensors associated with a person that detect heart rate and the like.

Various combinations of wired and wireless communication between smart nodes are possible involving power lines, Ethernet, WiFi, Bluetooth, UWB, and many other forms of communications.

Generally, a data protocol can be defined that enables a person to send and receive data via power line network adapters and communicate/control functions of stackable adapters (e.g., a WiFi node) and electrical appliances (e.g., lights) attached to stackable adapters.

Under one arrangement, smart node and smart node networks can be used in conjunction with power-over-Ethernet technologies Under another arrangement, smart nodes having microphones are networked with a central control system having voice recognition capabilities. Alternatively, a stackable adapter may have a microphone and voice recognition capabilities.

A power down conversion adapter may comprise at least one of a video display, power line networking adapter capability, and UWB signal source capability for driving a power line with a pulse signal used for radar tracking system.

Video displays can be integrated with outlets and with a wireless network (e.g., wi-fi, bluetooth) enabling video and/or pictures to be displayed and also interface with other devices (e.g., phones, smart TVs, appliances, etc.). Display could be size of phone or size of tablet display. Could include voice input capabilities (microphone & local voice recognition). Could include speaker/voice synthesizer capabilities While particular embodiments of the invention have been described, it will be understood, however, that the invention is not limited thereto, since modifications may be made by those skilled in the art, particularly in light of the foregoing teachings.

The invention claimed is:

1. A stackable electrical adapter, comprising:

one of a first electrical connector part that is located on a first side of said stackable electrical adapter, said first electrical connector part being configured to be detachably coupled to an electrical adapter, said electrical adapter comprising:

at least one of an electrical plug or an Edison screw base configured to receive a primary voltage from a primary voltage source; and a voltage converter circuit configured to convert the primary voltage to a secondary voltage; and one of a second electrical connector part that is located on a second side of said stackable electrical adapter that is opposite said first side, said second electrical connector part being configured to be detachably coupled to an electrical fixture configured to be powered by the secondary voltage, each of said first electrical connector part and said second electrical connector part comprising:

a first contact portion for providing a secondary voltage; and a second contact portion for providing a ground, said first and second contact portions of each said first electrical connector part being configured to provide an electrical connection with said first and second contact portions of each said second electrical connector part enabling daisy-chaining of multiple stackable electrical adapters.

2. The stackable electrical adapter of claim 1, wherein said primary voltage source is an electrical socket of an electrical outlet.

3. The stackable electrical adapter of claim 1, wherein said stackable electrical adapter comprises an audio input device.

4. The stackable electrical adapter of claim 1, wherein said stackable electrical adapter comprises an audio output device.

5. The stackable electrical adapter of claim 1, wherein said stackable electrical adapter comprises a video input device.

6. The stackable electrical adapter of claim 1, wherein said stackable electrical adapter comprises a video output device.

7. The stackable electrical adapter of claim 1, wherein said stackable electrical adapter comprises a radar.

8. The stackable electrical adapter of claim 1, wherein said stackable electrical adapter comprises an environment sensor.

9. The stackable electrical adapter of claim 1, wherein said stackable electrical adapter comprises a network communications device.

10. The stackable electrical adapter of claim 1, wherein said stackable electrical adapter comprises a security sensor.

11. The stackable electrical adapter of claim 1, wherein said stackable electrical adapter comprises a timer device.

12. The stackable electrical adapter of claim 1, wherein said stackable electrical adapter comprises a remote control repeater device.

13. The stackable electrical adapter of claim 1, wherein said stackable electrical adapter comprises a rechargeable battery.

14. The stackable electrical adapter of claim 1, wherein at least one of said stackable electrical adapter or said electrical fixture functions as part of one of a communication system, a tracking system, a security system, an environment control system, an environment monitoring system, a gaming system, an automation system, or a media delivery system.

15. The stackable electrical adapter of claim 1, wherein at least one of said stackable electrical adapter or said electrical fixture comprises at least one of a transponder, a transmitter, a receiver, or an antenna.

16. The stackable electrical adapter of claim 1, wherein said electrical adapter conveys signals via a wiring infrastructure to which an electrical outlet or an electrical fixture having an Edison screw light bulb socket is interfaced.

17. An electrical adapter system, comprising:

an electrical adapter, comprising:

at least one of an electrical plug or an Edison screw base configured to receive a primary voltage from a primary voltage source;

a voltage converter circuit configured to convert the primary voltage to a secondary voltage; and one of a first electrical connector part configured to be detachably coupled to one of a second electrical connector part of an electrical fixture configured to be powered by the secondary voltage; and at least one stackable electrical adapter configured to be placed between said electrical adapter and said electrical fixture, each said stackable electrical adapter of said at least one stackable electrical adapter having one of said first electrical connector part that is located on a first side and having one of said second electrical connector part that is located on a second side that is opposite said first side, each said first electrical connector part and each said second electrical connector part comprising:

a first contact portion for providing said secondary voltage; and a second contact portion for providing a ground, said first and second contact portions of each said first electrical connector part being configured to provide an electrical connection with said first and second contact portions of each said second electrical connector part enabling daisy-chaining of multiple stackable electrical adapters between said electrical adapter and said electrical fixture.

18. The electrical adapter system of claim 17, wherein said electrical adapter further comprises another electrical socket that outputs a voltage based on the primary voltage.

* * * * *